US007934287B2

(12) United States Patent
De Soto-Burt et al.

(10) Patent No.: US 7,934,287 B2
(45) **Date of Patent: *May 3, 2011**

(54) HEAD FOR A CLEANING IMPLEMENT HAVING A REMOVABLE DIRT BIN

(75) Inventors: Widalys Luz De Soto-Burt, Cincinnati, OH (US); Kerry Lloyd Weaver, Florence, KY (US); Brian David Andres, Harrison, OH (US); Paul John Edward Vernon, Hamilton, OH (US); Nicola John Policicchio, Mason, OH (US); Brett Delainey, Seattle, WA (US)

(73) Assignee: The Procter & Gamble Company, Cincinnati, OH (US)

( * ) Notice: Subject to any disclaimer, the term of this patent is extended or adjusted under 35 U.S.C. 154(b) by 252 days.

This patent is subject to a terminal disclaimer.

(21) Appl. No.: 12/221,115

(22) Filed: Jul. 31, 2008

(65) Prior Publication Data

US 2010/0024156 A1 Feb. 4, 2010

(51) Int. Cl.
*A47L 9/08* (2006.01)

(52) U.S. Cl. ..... 15/339; 15/98; 15/352; 15/373; 15/403; 15/DIG. 8

(58) Field of Classification Search ..... 15/49.1, 15/98, 352, 339, 365, 373, 403, DIG. 8; *A47L 9/06*
See application file for complete search history.

(56) References Cited

U.S. PATENT DOCUMENTS

| | | | | |
|---|---|---|---|---|
| 6,305,046 | B1 | 10/2001 | Kingry et al. | |
| 6,484,346 | B2 | 11/2002 | Kingry et al. | |
| 6,651,290 | B2 | 11/2003 | Kingry et al. | |
| D489,537 | S | 5/2004 | Wong et al. | |
| 6,797,357 | B2 | 9/2004 | Fereshtehkhou et al. | |
| D499,887 | S | 12/2004 | Wong et al. | |
| 6,936,330 | B2 | 8/2005 | Fereshtehkhou et al. | |
| 2004/0168281 | A1 * | 9/2004 | Sako et al. | 15/364 |
| 2004/0211022 | A1 * | 10/2004 | Fan | 15/344 |
| 2005/0181968 | A1 | 8/2005 | Policicchio et al. | |

FOREIGN PATENT DOCUMENTS

GB 2 389 035 A 12/2003

OTHER PUBLICATIONS

U.S. Appl. No. 12/221,080, filed Jul. 31, 2008, Paul John Edward Vernon et al.
U.S. Appl. No. 12/221,079, filed Jul. 31, 2008, Nicola John Policicchio et al.

* cited by examiner

*Primary Examiner* — David A Redding
(74) *Attorney, Agent, or Firm* — Larry L. Huston; Leonard W. Lewis; Steven W. Miller

(57) ABSTRACT

A cleaning implement having a dirt bin for collecting debris from a floor. The dirt bin has at least one of a cleaning sheet and/or air filter attached thereto, as presented to the user. This arrangement allows for more efficient disposal of debris from the dirt bin and soiled components. The dirt bin may be emptied and reused or may be discarded after a single use.

17 Claims, 5 Drawing Sheets

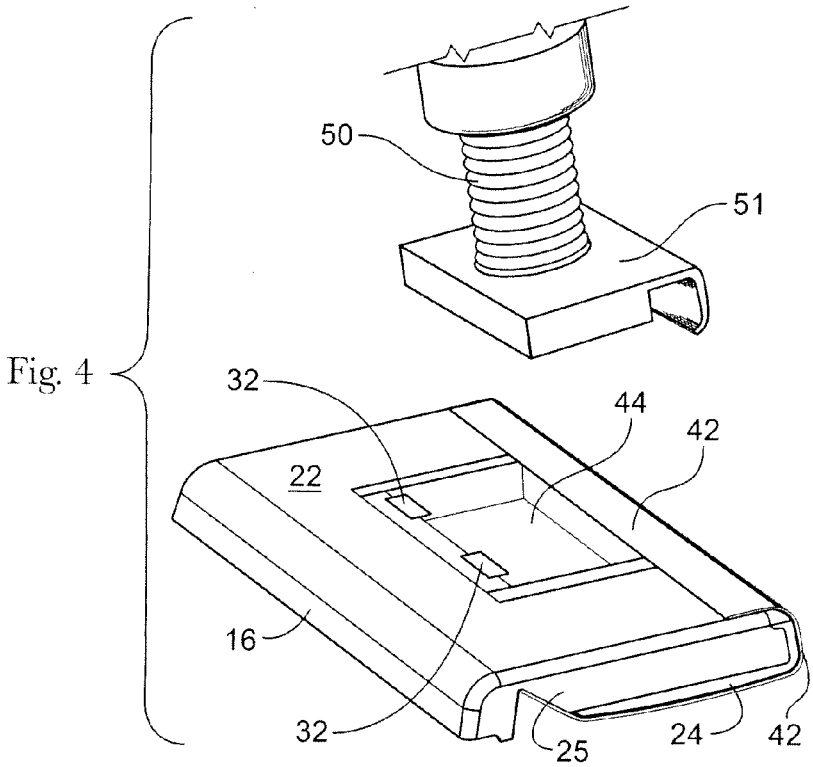
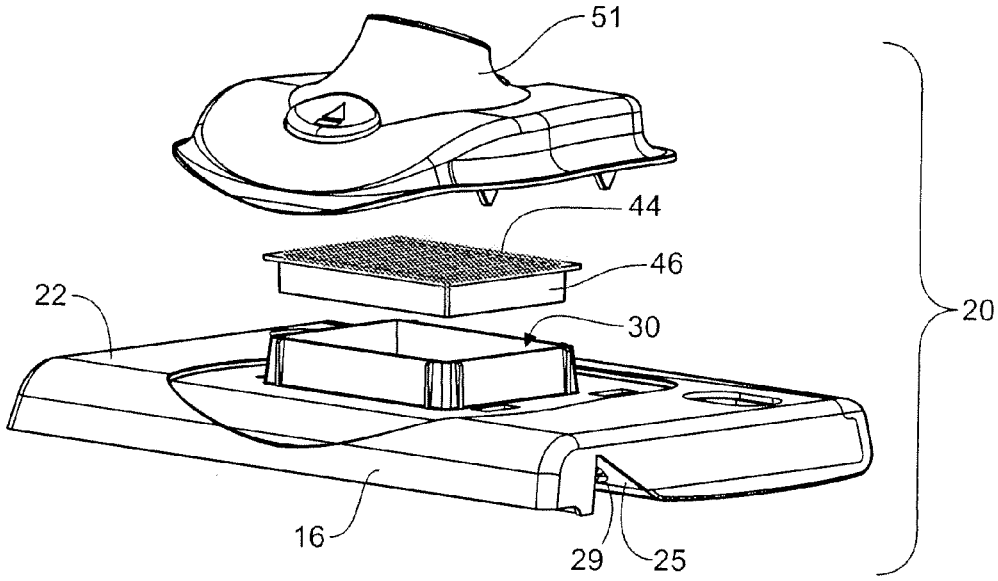
Fig. 5

HEAD FOR A CLEANING IMPLEMENT HAVING A REMOVABLE DIRT BIN

FIELD OF THE INVENTION

The present invention relates to cleaning devices and more particularly to cleaning devices having a disposable cloth for removing debris from a target surface.

BACKGROUND OF THE INVENTION

Powered cleaning devices which remove debris from a target surface, such as flooring, carpet, etc. are well known in the art. The removed debris is collected in a dirt bin. Such devices utilize different means for bringing the debris into the dirt bin. Such means include vacuum induced by a fan and/or one or more powered axially rotatable rollers. The rollers are disposed in a head which contacts and moves relative to the target surface. A handle may be provided to allow the user to deploy the device while standing and increase reach.

An additional way to remove debris from the target surface is to use a disposable cloth. The cloth may be removably attached to the head, and particularly to the underside of the head. Suitable cloths include nonwovens, microfiber, yarns and compostable materials, such as PLA, etc. Suitable cloths may be made according to the teachings of commonly assigned U.S. Pat. Nos. 6,797,357; 6,936,330; D489,537 and/or D499,887.

The cloth may be disposable, i.e. discarded after being soiled. The cloth may be discarded after a single use. Alternatively, the cloth may laundered and restored, for subsequent reuse. After subsequent reuse, the disposable cloth may then be discarded.

The cloth may be removably attached to the head using hook and loop fasteners, resiliently deformable grippers, adhesive, cohesion, spring loaded clips, etc. Suitable grippers may be made according to the teachings of commonly assigned U.S. Pat. Nos. 6,305,046; 6,484,346 and/or 6,651,290.

The dirt bin may be removably disposed on the handle, body or head. Upon removal, debris collected in the bin may be discarded and the bin reattached to the device. Disposing the dirt bin on the handle may provide the benefit of ergonomic attachment and removal. Disposing the dirt bin on the head provides the benefit of a relatively shorter path for the debris to travel for collection.

The dirt bin may be any suitable receptacle for temporary or permanent collection of debris. The collection is considered permanent if the dirt bin, and its contents, are discarded after use. The collection is considered temporary if the contents are substantially emptied from the dirt bin for discarding, and the dirt bin is reused.

Emptying the dirt bin may be accomplished by first removing it from the cleaning implement. The dirt bin may then be transported to a trash can and the debris emptied from the dirt bin into the trash can. The dirt bin may be emptied by inverting it and allowing the debris to fall out by gravity. This process can be unsanitary and ergonomically challenging.

This process is generally repeated if the cleaning implement has a disposable sheet on the head. The dirty sheet has to be removed, which may entail another trip to transport the used sheet to the trash can. Alternatively, the user can take the entire cleaning implement to a trash can, to both empty the dirt bin and discard a soiled cleaning sheet. However, this can be inconvenient if the trash can is not near the cleaning area or if the implement is heavy or bulky.

If a fan is used to provide a vacuum for collection of debris, the fan may provide an air flow. The air flow travels in an air flow path. The air flow path originates near the surface on which the debris is exposed, deposits entrained debris in the dirt bin and exits the cleaning implement through an exhaust.

A filter may be disposed in the air flow path. The filter may be disposed after the dirt bin, so that large particulate debris is deposited in the dirt bin. The filter may comprise any suitable porous media, such as a nonwoven sheet.

As the filter becomes clogged, due to ordinary use, the efficacy of the cleaning implement is usually diminished. For example, the quantity of air flow may be reduced, providing less debris pickup.

It can be seen there are many opportunities to improve cleaning implements according to the prior art.

SUMMARY OF THE INVENTION

The invention comprises a cleaning implement. The cleaning implement has a head for contacting a surface to be cleaned, a removable dirt bin for receiving debris collected from said surface, and a source of vacuum for moving debris from the surface to said dirt bin via an airflow path. An air filter and/or cleaning sheet is/are removably attached to the dirt bin, whereby the air filter and/or cleaning sheet can be removed from the balance of the cleaning implement together with the dirt bin.

All patents and pending applications cited herein are incorporated herein by reference.

BRIEF DESCRIPTION OF THE DRAWINGS

FIG. 4 is a fragmentary, perspective, exploded view of a hose and detachable air filter with a unitary sheet to be mounted on the head of a cleaning implement.

FIG. 5 is an exploded perspective view of a removable dirt bin and a separate air filter to be mounted thereon.

DETAILED DESCRIPTION OF THE INVENTION

Figures 1A, 1B:
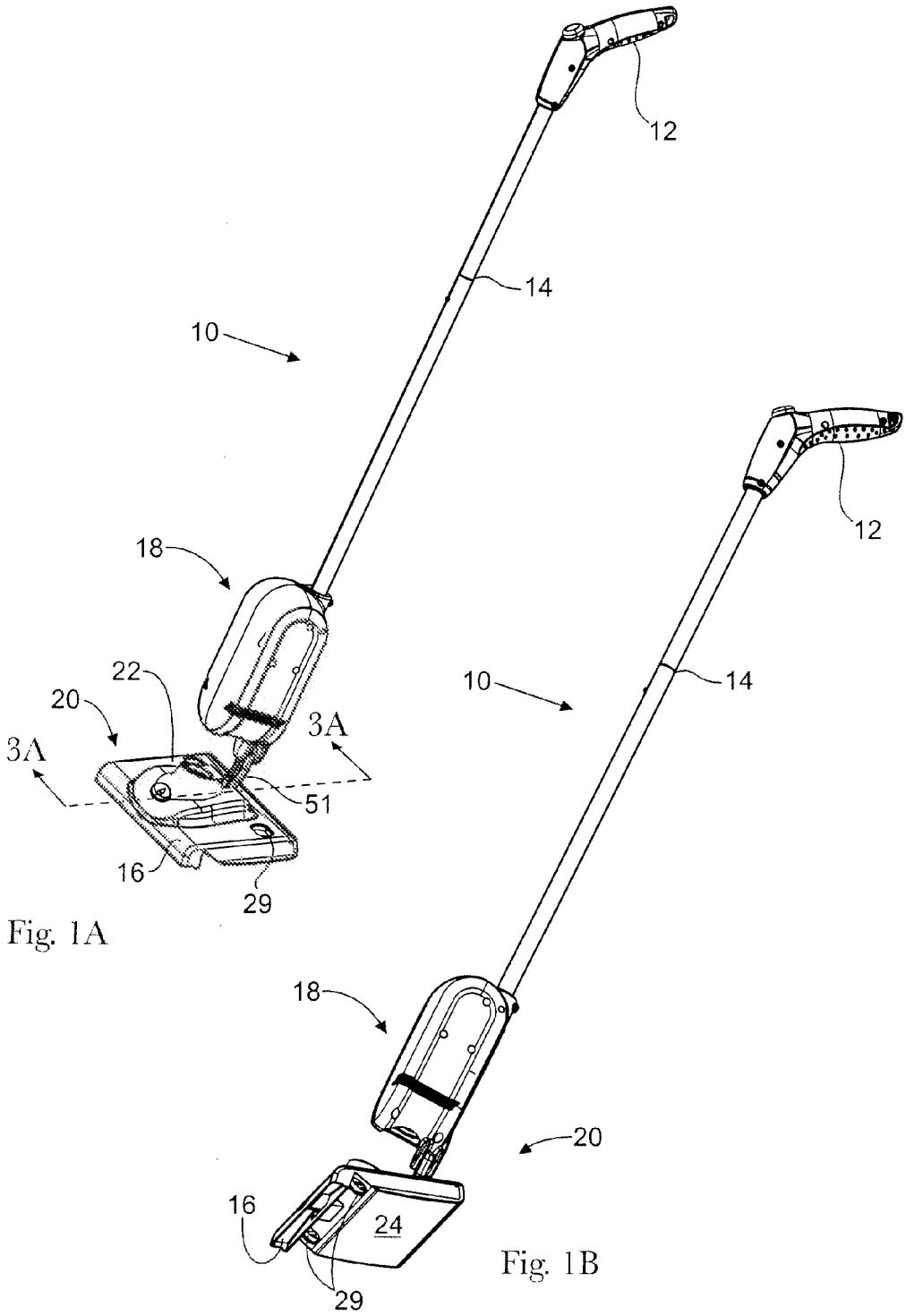
FIGS. 1A and 1B are perspective views of an exemplary cleaning implement according to the present invention.

Referring to FIGS. 1A and 1B, the cleaning implement 10 according to the present invention may comprise a head 20, a handle 12 and a pole 14 therebetween. The implement 10 may further comprise a body 18 mounted on the pole 14 as shown, or the components of the body 18 may be integrated into the head 20.

The head 20 may comprise attachments 29 for removably receiving a cleaning sheet 42, a removable dirt bin 30, a suction nozzle 16 and other components as may be helpful. The body 18 may comprise a fan, a motor therefor, batteries to power the motor if line current is not used, or an inlet for the power cord if line current is utilized, an exhaust for the air flow, and other components as may be helpful. There is also provision for communication of air flow between the head 20 and body 18.

The handle 12 may provide for ergonomic manipulation of the implement 10. An on-off switch may be disposed on the handle 12, body 18, head 20 or pole 14. While an implement 10 suitable for a standing user is illustrated, the invention is not so limited. The pole 14 may be shortened or eliminated and the handle 12 configured for hand-held ergonomics or for use on one's hands and knees.

As used herein horizontal refers to the primary direction of the movement of the head 20 of the implement 10 along a horizontal target surface and which occurs within the plane of the target surface. Vertical refers to the direction perpendicular to the target surface and horizontal direction, and which spaces apart the top surface 22 and bottom surface 24. The width of the implement 10 refers to the left-right direction as it is in use. The front-back direction is perpendicular thereto and parallel to the target surface.

Examining the components in more detail, the head 20 may comprise a top or generally upwardly facing surface and a bottom surface 24 opposed thereto. The head 20, and particularly the bottom surface 24 thereof, moves relative to the target surface to be cleaned.

The target surface may be a floor, and more particularly a hard surface floor, such as tile, hardwood, linoleum, etc. A cleaning sheet 42 may be attached to the bottom surface 24, using attachments 29 as are known in the art.

Exemplary attachments 29 include deformable grippers, etc. Deformable grippers may be used to attach the cleaning sheet 42, because such an attachment works with a variety of sheet 42 materials, does not require extra manufacturing steps in the sheet 42 (such as the addition of adhesive) and may last for the life of the implement 10.

While uniform and substantially identical attachments 29 are typically used, the invention is not so limited. The attachments 29 may comprise two or more different attachment types.

Three or more grippers may be used. If four grippers are utilized, they may be disposed in a rectangular pattern comprising two front attachments 29 and two rearward attachments 29, as shown. One or more of the attachments 29 may be disposed on the top surface 22 of the head 20 and generally face away from the bottom surface 24 of the head 20 and target surface during cleaning. This disposition of attachments 29 provides the benefit of convenient access thereto.

One or more of the attachments 29 may be disposed on an acute surface 25. The acute surface 25 is any surface having a principal orientation disposed at an acute angle relative to the target surface when the bottom surface 24 of the head 20 is disposed thereon. The acute surface 25 may form a principal acute angle with either the general plane of the top surface 22 or bottom surface 24 of the head 20. The acute surface 25 may form an angle of at least 15 or 30 degrees, and not more than 75 or 60 degrees with the target surface when the head 20 is placed thereon in the usage disposition.

If the acute surface 25 is curvilinear, its orientation is taken at the outwardly oriented centroid. The acute surface 25 may be stationary, and not move relative to the balance of the head 20.

The acute surface 25 may be downwardly oriented, i.e. oriented towards the target surface during ordinary use. Providing a stationary and permanently downwardly oriented surface onto which the attachments 29 may be disposed avoids the complex pivoting mechanism found, for example, in US 2004/0045126 A1.

The acute surface 25 may be disposed intermediate the suction nozzle 16 and rearward attachments 29. The acute surface 25 may face outwardly, i.e. towards the front of the head 20 and suction nozzle 16 or inwardly, towards the center of the head 20. The acute surface 25 may be flat as shown or may be concavely oriented forward. The concave geometry offers the advantage that debris may be scooped towards the center of the head 20 and more likely be collected by the implement 10.

Disposing the attachments 29 on an acute surface 25 provide the benefit the attachments 29 may be accessed without moving the suction nozzle 16. This disposition allows the suction nozzle 16 to be pivotably attached to the head 20, as illustrated by U.S. Pat. No. 7,293,322 B2 or, alternatively, to be held stationary.

If desired, two forward attachments 29 may be disposed on the acute surface 25 and two rearward attachments 29 may be disposed on the top surface 22 of the head 20. This arrangement provides the benefit that the sheet 42 may wrap the back of the head 20 and cover the head 20, and also cover the front of the head 20 up to the suction nozzle 16.

The attachments 29 may be grippers, as described herein. The grippers may have a major axis. The major axes of the grippers may be oriented in the width direction, as illustrated. Alternatively, the major axes of the grippers may be oriented at approximately 45 degrees to the width direction and the front-back direction. This orientation may provide improved tensioning of the cloth onto the head 20.

Figure 2A:
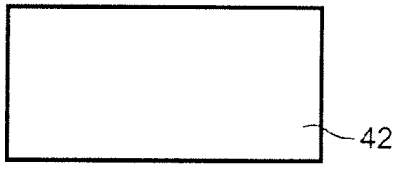
FIGS. 2A-2B are frontal views of exemplary sheets usable with the cleaning implement of FIG. 1.

Referring to FIG. 2A, the cleaning sheet 42 may be generally rectangular. If so, and if four attachments 29 are utilized, one corner of the sheet 42 may be juxtaposed with, and removably joined to each attachment. The cleaning sheet 42 may be disposable or may be restored and reused. The cleaning sheet 42 may cover most, or all, of the bottom surface 24 of the head 20.

Figure 3A:
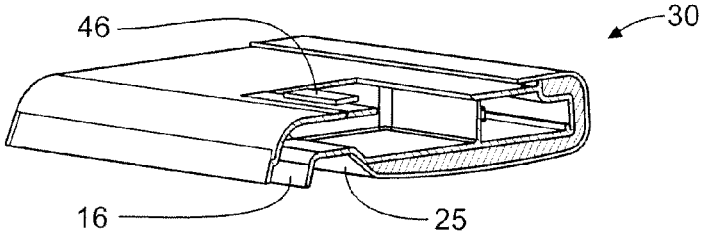
FIG. 3A is a fragmentary, vertical sectional view, taken along lines 3A-3A of FIG. 1A showing an acute recessed surface.

Referring to FIG. 3A, a portion of the cleaning sheet 42 may also be used as a filter 44 for the air flow. To do so, such portion of the sheet 42 may be disposed in the air flow path and not be disposed on the bottom surface 24 of the head 20. Referring back to FIG. 2A, if a rectangular sheet 42 is selected a marginal portion of the sheet 42 may be disposed in the air flow path. In such an embodiment the sheet 42 may be folded as shown. This geometry places at least a portion of the longer edge of a rectangular sheet 42 in the air flow path. This arrangement provides the benefit that only four attachments 29 are necessary to removably dispose the sheet 42 and air filter 44 on the cleaning implement 10.

Figure 3B:
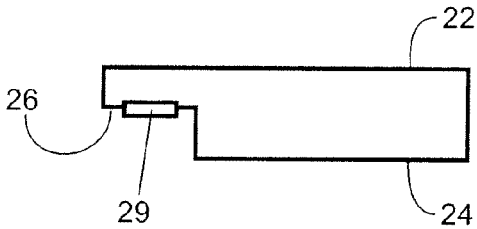
FIG. 3B is a vertical sectional view of an alternative embodiment of a bottom surface of an implement according to the present invention showing an offset recessed surface.

Referring to FIG. 3B, the downwardly oriented surface which onto which one or more attachments 29 is disposed may be offset from the balance of the bottom surface 24, and thereby displaced from the target surface when it is being cleaned by the cloth. The offset surface 26 having attachments 29 disposed thereon may be generally or identically parallel the bottom surface 24 of the head 20 and the target surface to be cleaned.

The offset surface 26 may be displaced from the bottom surface 24 a distance at least equivalent to the thickness of the cloth attached to the head 20. A suitable offset, taken in the vertical direction may be at least 1, 5 or 10 mm and not more than 20, 15 or 10 mm. The offset may be a step change, as illustrated in FIG. 3B, or may be curvilinear in either plane.

The offset surface 26 having attachments 29 disposed thereon and the acute surface 25 having attachments 29 disposed thereon both provide the advantage that improved flexibility is available for placement of the attachments 29 on the head 20. It is no longer necessary to place all attachments 29 on the top surface 22 of the head 20 or to have complex, moveable assemblies to accommodate the attachments 29.

An acute surface 25 and an offset surface 26 are referred to collectively as a recessed surface. The recessed surface may have one, two or more attachments 29, such as grippers, disposed thereon. Of course, one of skill will recognize hybrid recessed surfaces are feasible. For example, an offset surface 26 may also be acute.

Figure 2B:
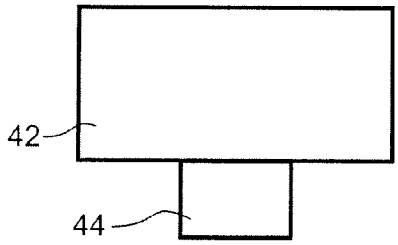

Referring back to FIG. 2B, this geometry may be enhanced by using a generally T-shaped cloth. The larger portion (e.g. cross-bar) of the T may be disposed on the bottom surface 24 of the head 20. The smaller portion (e.g. upright) of the T may be used as a filter 44 and disposed in the air flow path. This geometry provides the benefit of providing a larger air filter 44, without sacrificing area used for cleaning on the bottom surface 24 of the head 20. If desired, such an arrangement may be utilized with four or with six attachments 29.

Of course, one of skill will recognize other shapes are also suitable for the cleaning sheet 42/filter 44 combination. Such shapes may include variable widths, as shown, asymmetric shapes, etc.

The attachments 29 for the filter 44 portion and the cleaning portion of the sheet 42 may be the same or different. For example, attachments 29 which are ergonomic may be used for the cleaning portion while attachments 29 which provide a more secure fit and reduced wrinkling may be used for the filter 44 portion of the sheet 42. This arrangement balances the need for convenience with the need to prevent wrinkles, and hence bypass air flow, around the filter 44.

The foregoing arrangements provide the benefit of a unitary cleaning sheet 42 and filter 44. By unitary it is meant the two components are joined together and cannot be separated without tearing or gross deformation. The two components may be unitary by being manufactured as integral. By integral is meant the sheet 42 and filter 44 comprise a monolithic structure.

Alternatively, the sheet 42 and filter 44 may be manufactured separately and joined together to comprise a unitary assembly. The two components may be permanently or removably joined by adhesive, heat sealing, ultrasonic welding, hook and loop fasteners, etc., as are known in the art.

This dual material arrangement provides the benefit that sophisticated materials are not necessary to be used for the air filter 44. Frequently, users will neglect to change the air filter 44, resulting in clogged air flow, diminishing the cleaning capability of the implement 10. Some attempts to overcome this problem have included using more sophisticated materials or using pleats, etc., to increase the amount of material utilized. Either attempt increases the cost of the filter 44.

In contrast, using the aforementioned unitary sheet 42 and filter 44 requires the filter 44 to be changed very time the floor cleaning sheet 42 is changed. Since most consumers change the cleaning sheet 42 after each usage, the filter 44 is likewise changed after each usage and a new filter 44 presented for each subsequent use. This arrangement provides the solution that inexpensive filter 44 materials may be utilized without diminishing the performance of the cleaning implement 10.

If desired, the portion of material designated for cleaning and the portion designated for air filtration may have the same or different basis weight, texture, topography, pore volume distribution, thickness, density, material, fiber composition percentages, color, or other intensive properties. If different properties, such as the properties mentioned above, or properties such as surface area, are selected, either the sheet 42 portion or the filter 44 portion may be greater or lesser than the other. For example, if desired the cleaning sheet 42 portion may have greater texture than the filter 44 portion to trap debris from the target surface, while the air filter 44 portion may have greater basis weight than the cleaning sheet 42 portion to trap debris from the air flow path.

Additionally or alternatively, either or both of the cleaning sheet 42 and/or filter 44 may have indicia disposed thereon. The indicia may be printed, embossed, etc. and identify the different portions of the cloth as to sheet 42 vs. filter 44, be a trademark, provide installation or discarding instructions, etc.

If desired, the cleaning sheet 42 and air filter 44 may comprise bicomponent fibers having a PE sheath/PP core or comprise PE throughout. Such materials provide convenient heat sealing for joining together separate components, if the cleaning portion and filter 44 portion of the sheet 42 are not manufactured as an integral unit.

Figure 2C:
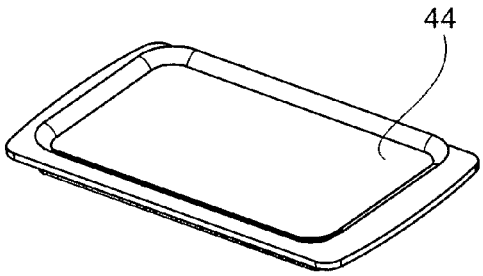
FIGS. 2C-2D are frontal and rear perspective views of an air filter circumscribed by a rigid frame.
Figure 2D:
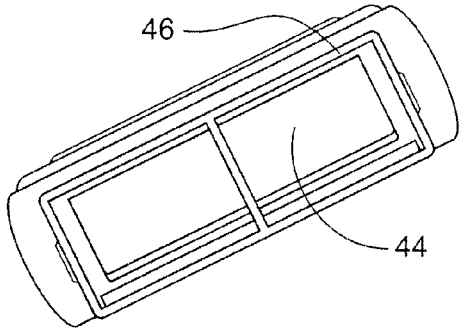

Referring to FIGS. 2C-2D, if desired the filter 44 may be a separate component and not joined to the cleaning sheet 42. Such a filter 44 may have a frame to hold it taut and avoid bypass flow. The sheet and frame assembly may be disposed on the top surface 22 of the head 20.

Referring to FIGS. 4-5, the provision for communication of air flow between the head 20 and body 18 may comprise a rigid or flexible hose or tubing, referred to hereinafter as a hose 50. The hose 50 may have a proximal end 51 permanently or removably attached to the head 20 and a distal end permanently or removably attached to the body 18. Air flow may begin in and/or exhaust from the body 18, as initiated by a powered fan, as is well known in the art.

Air flow from the fan may enter the head 20 through bottom surface 24 of the head 20 or though such other position where the suction nozzle 16 may be disposed. Air flow may exit the head 20 and enter the hose 50 through an opening in the top surface 22 of the head 20.

If the hose 50 is removably attached at the proximal end 51 to the head 20, and if the air filter 44 has a rigid frame, the proximal end 51 of the hose 50 may have a geometry which corresponds with the geometry of the opening in the top surface 22 of the head 20. A filter 44 of the type exemplified in FIGS. 2C-2D may be inserted over the opening and clamped in place using the proximal end of the hose 50.

The rigid frame may be polymeric and more particularly PP, LDPE or HDPE. The frame may circumscribe the filter 44 material with a resilient seal 46. The seal 46 may be compressed by the compression of the proximal end of the hose 50 against the top surface 22 of the head 20, forming a seal 46 around the air filter 44.

The filter 44 may additionally or alternatively have other mechanisms for attachment to either or both of the proximal end of the hose 50 or the top surface 22 of the head 20 circumscribing the opening. Exemplary additional attachments 29 include hook and loop fasteners, adhesive, spring clips, grippers, etc. One of skill will recognize that the frame of the filter 44 may be optionally eliminated if the attachment mechanism so provides.

Referring to FIG. 5 in an alternative embodiment, the dirt bin 30 may have an opening in the top. The filter 44 may cover the opening. Air flow enters the dirt bin 30, deposits debris and exits the dirt bin 30 through the filter 44. Debris is also collected on the filter 44. A cleaning sheet 42 may be removably attached to the bottom of the dirt bin 30. The cleaning sheet 42 and filter 44 may be unitary, more particularly integral, or may comprise two separate components.

This arrangement provides the benefit that the dirt bin 30 has both a cleaning sheet 42 and air filter 441 removably attached thereto. When the cleaning task is completed, the user removes the dirt bin 30, with the filter 44 and cleaning sheet 42 attached thereto from the head 20 of the implement 10. The user may then conveniently transport only the dirt bin 30, filter 44 and sheet 42 to a trash can for discarding the debris, the soiled cleaning sheet 42 and/or filter 44. This process provides the benefit that all soiled components and the debris may be discarded in a single, efficient operation. By discarding all soiled components and the debris in a single operation, the operation becomes more sanitary than discarding each in a separate step.

One of skill will recognize the dirt bin 30 may carry one or the other of the filter 44 or cleaning sheet 42, rather than both as described above. Thus, the dirt bin 30 may be carried to the trash can to discard only debris and either (or both) of the cleaning sheet 42 and/or air filter 44.

Figure 6A:
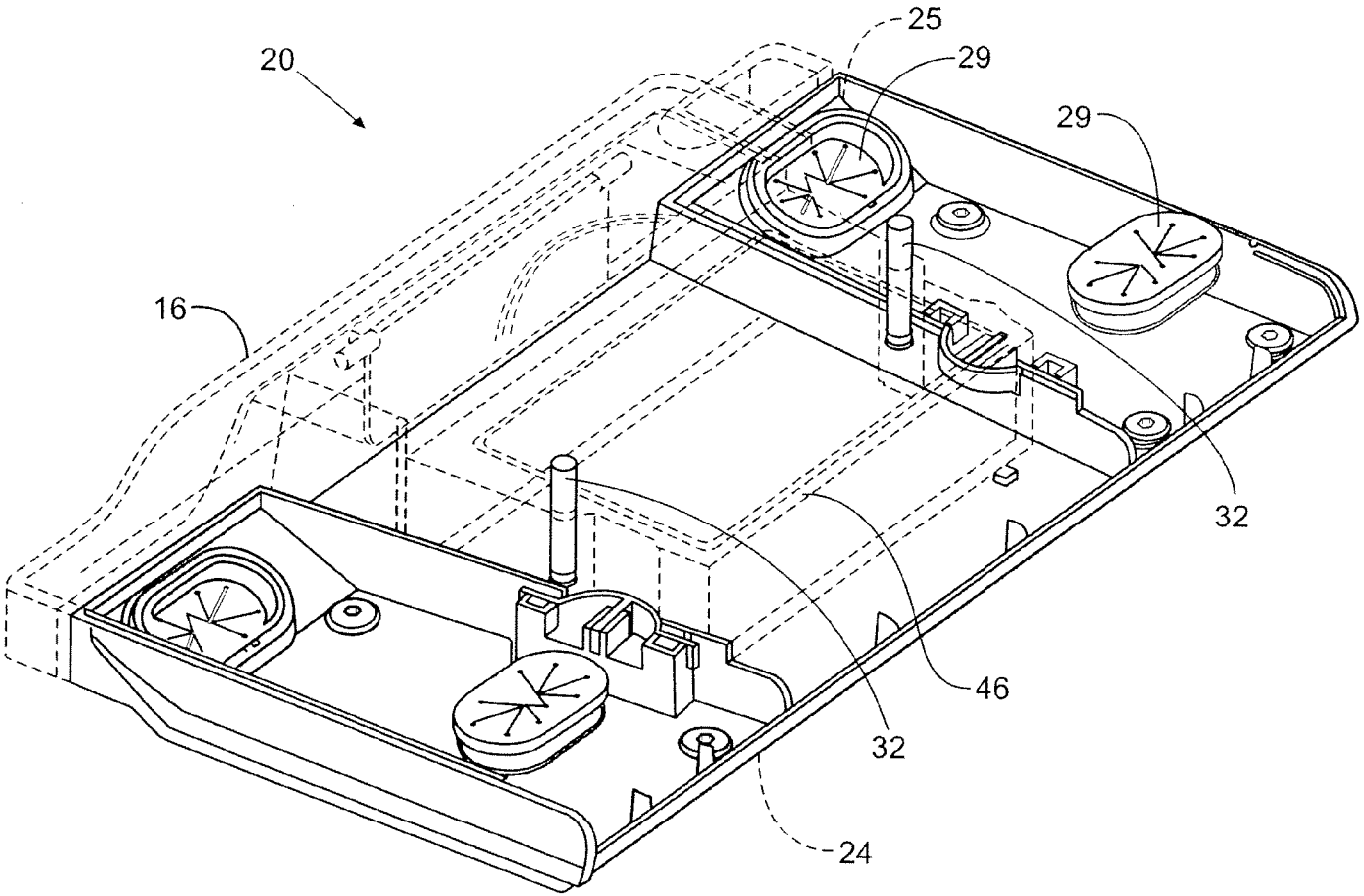
FIGS. 6A and 6B are perspective views, shown in phantom, with the top surface 22 omitted for clarity having the spring loaded pins extended without a filter installed and retracted with the pins installed, respectively.
Figure 6B:
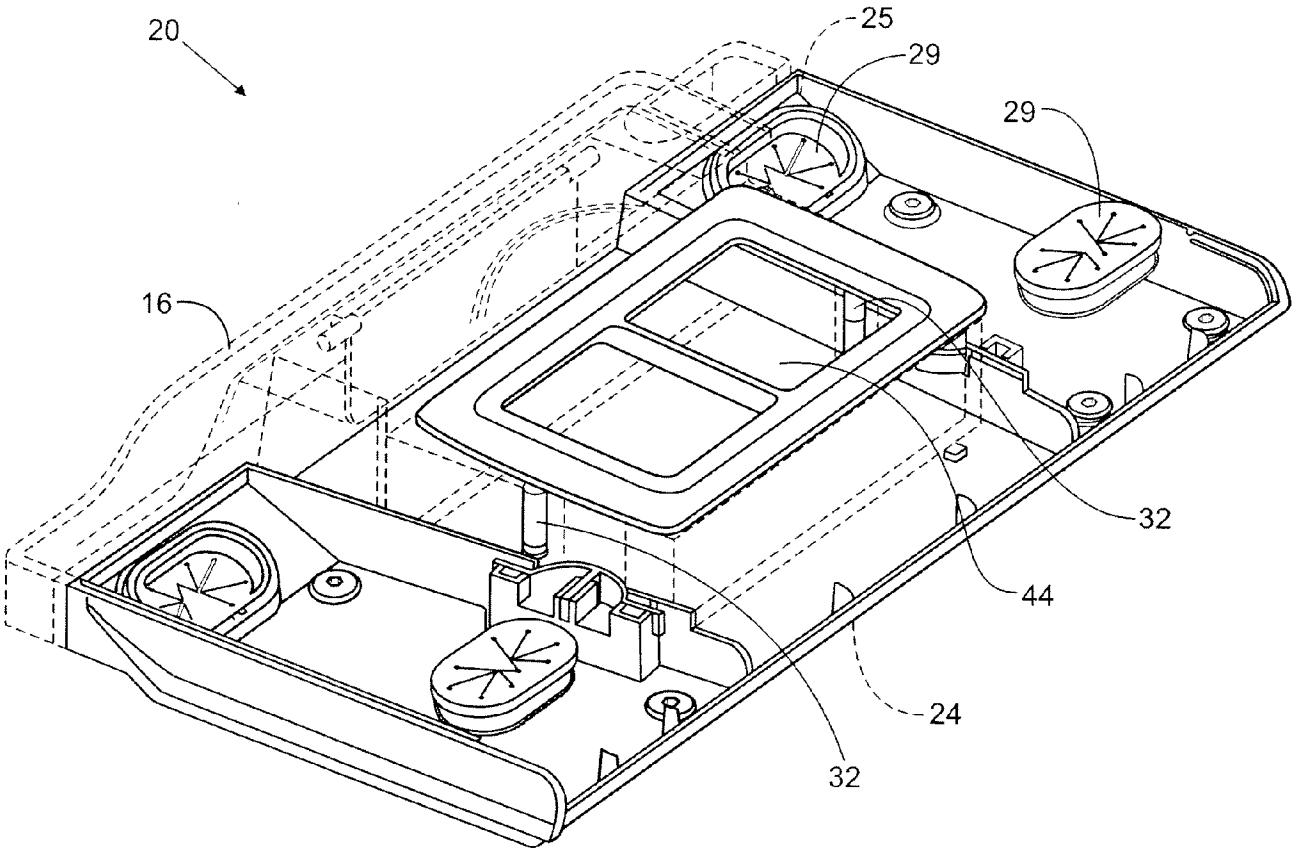

Referring to FIGS. 6A and 6B, if desired the implement 10 may further comprise an interlock to prevent inserting the dirt bin 30 into position in the head 20 without having a filter 44 properly installed. The interlock may comprise one or more spring loaded pins 32.

Referring to FIG. 6A, the pins 32 may be cantilevered from and retractably extend from the dirt bin 30, as shown. With the pins 32 extended, the dirt bin 30 cannot be inserted into position, as obstruction by the pins 32 prevent insertion of the dirt bin 30 into the head 20.

Referring to FIG. 6B, the pins 32 may be retracted by compressing the springs which extend the pins 32 as shown. The pins 32 are thereby retracted, and the dirt bin 30 may be slid into place or otherwise inserted into the head 20 of the implement 10.

While pins 32 which travel in a linear path are shown in FIGS. 6A and 6B, the invention is not so limited. One of skill will understand the pins 32 may alternatively pivot about an axis. Such pins 32 are again extended when the dirt bin 30 is removed from the head 20. Such pins 32 again articulate to a retracted position when the air filter 44 is put into place.

Articulable pins 32 may be spring loaded to be biased towards an extended position using torsional springs, as are known in the art. One of skill will recognize the size and geometry of the pins 32 may be tailored to match the geometries of the dirt bin 30 and head 20 combination. Thus the pins 32 may be shaped like arms, bars, and other elements.

The body 18 may be mounted on, and optionally removable from, the pole 14. The body 18 may also carry and/or enclose the fan, a motor therefor, batteries, etc. The body 18, and balance of the cleaning implement 10 may generally be constructed in accordance with the teachings of US 2007/0062000 A1, published Mar. 22, 2007.

One of skill will further recognize that if a reusable filter 44 or reusable cleaning cloth is used, either or both may be removed from the dirt bin 30 and restored for future use when debris is discarded from the dirt bin 30. Similar to the procedure discussed above, this arrangement provides the benefit that a new (or restored) air filter 44 and/or cleaning sheet 42 may be ergonomically replaced on the dirt bin 30 while the dirt bin 30 is placed on a counter, table top, etc. In this manner, the user is not required bend down to replace such components while the head 20 is on the floor, but instead need only replace the dirt bin 30 into the head 20 of the cleaning implement 10.

One of skill will further recognize the dirt bin 30 need not be reusable, as hereinbefore described. The dirt bin 30 may be disposable, and discarded after a single use. Such a dirt bin 30 may be made of inexpensive polymeric material, such as HDPE, may have a rigid polymeric frame and polymeric film sheets such as LDPE connecting the frame elements, corrugated cardboard, molded cellulosic pulp, closed cell reticulated foam, thermoformed trays, combinations thereof, etc.

The dirt bin 30 may be manufactured with either or both of the cleaning sheet 42 and/or air filter 44 attached thereto. This arrangement provides the advantage that the user need only discard the dirt bin 30, and not separately discard the debris therefrom and then reuse the dirt bin 30, with residual: debris therein. Likewise, the soiled air filter 44 and/or soiled cleaning sheet 42 are discarded with the dirt bin 30, and not removed therefrom and then discarded. Again, a more ergonomic and sanitary process is presented.

After discarding such components, the user may replace the soiled dirt bin 30 with a new dirt bin 30. The new dirt bin 30 may have a cleaning sheet 42, air filter 44, neither or both attached thereto as presented to the user at the point of use. The air filter 44 and/or cleaning sheet 42 may alternatively, be attached to other portions of the head 20 or may be separately attached to the dirt bin 30 before it is inserted back into the head 20.

This arrangement further allows the consumer to purchase replacement dirt bins 30 with or without a cleaning sheet 42 and/or air filter 44 disposed thereon, as a kit. The kit may contain a plurality of such assemblies. The assemblies may be identical or different.

For example, the kit may comprise separate components of filters 44, dirt bins 30 and cleaning sheets 42 which are assembled by the user at the point of use or which come assembled in the kit. Some sheets 42 and/or filters 44 may be heavier for more taxing cleaning jobs, some may have disinfectant for cleaning areas which may have known germs, some may be scented if desired to leave an aroma, etc. Such a kit allows the user to tailor the dirt bin 30, cleaning sheet 42 and or filter 44 to the immediate task.

The foregoing description lists but some of the non-limiting and illustrative embodiments off the invention, which invention, and all of its variations, are only limited by the scope of the claims below and their legal equivalents

What is claimed is:

1. A cleaning implement comprising:

a head for contacting a surface to be cleaned;

a dirt bin removably received in said head for receiving debris collected from said surface, said dirt bin being removable from the balance of said implement;

a source of vacuum for moving debris from the surface to said dirt bin via an airflow path, and a cleaning sheet for cleaning a surface while said dirt bin is received in said head being attached to said dirt bin, whereby said dirt bin and said cleaning sheet can be removed from the balance of said implement together as an integral assembly.

2. A cleaning implement according to claim 1 further comprising an air filter attached to said dirt bin.

3. A cleaning implement according to claim 2 wherein said air filter and said cleaning sheet comprise a unitary assembly.

4. A cleaning implement according to claim 1 wherein said head has a top surface and a bottom surface opposed thereto, and an opening for airflow therethrough disposed on said top surface, wherein said filter covers said opening.

5. A cleaning implement according to claim 2 wherein said air filter is removably attached to said dirt bin.

6. A cleaning implement according to claim 1 wherein said cleaning sheet is removably attached to said dirt bin.

7. A cleaning implement according to claim 2 wherein at least one of said cleaning sheet and said air filter are permanently attached to said dirt bin.

8. A cleaning implement according to claim 1 wherein said dirt bin comprises a thermoformed material.

9. A cleaning implement according to claim 1 wherein said dirt bin comprises cellulosic material.

10. A cleaning implement comprising:

a head for contacting a surface to be cleaned;

a dirt bin removably received in said head for receiving debris collected from said surface, said dirt bin being removable from the balance of said implement;

a source of vacuum for moving debris from the surface to said dirt bin via an airflow path, and at least one of an air filter disposable in said airflow path when said dirt bin is received in said head and a cleaning sheet for cleaning a surface while said dirt bin is received in said head being attached to said dirt bin, whereby said dirt bin and said at least one of said filter and/or said cleaning sheet can be removed from the balance of said implement together, said implement further comprising an interlock for preventing insertion of said dirt bin into said head without a filter attached to said dirt bin.

11. A cleaning implement according to claim 10 wherein said interlock comprises at least one spring loaded pin, said pin being retracted when said filter is attached to said dirt bin and extended when said filter is not attached to said dirt bin.

12. A cleaning implement according to claim 11 wherein said spring loaded pins moves in a substantially linear path.

13. A method of maintaining a powered cleaning implement having a cleaning sheet for contacting a floor to be cleaned and a dirt bin for receiving debris therein, said cleaning sheet being removably attached to said dirt bin, said method comprising the steps of:

a) removing said dirt bin from the balance of said implement with said cleaning sheet attached thereto;

b) discarding debris from said dirt bin;

c) removing said cleaning sheet from said dirt bin, wherein steps b and c are performed in either order;

d) attaching a second cleaning sheet to said dirt bin;

e) discarding said first cleaning sheet, wherein steps d and e are performed in either order; and f) inserting said dirt bin with said second cleaning sheet attached thereto into the balance of said implement, wherein said steps e and f are performed in either order.

14. A kit comprising a plurality of dirt bins, each said dirt bin having a top, a bottom and fitting into a head of a cleaning implement for collecting debris therein, each of said dirt bins having a cleaning sheet attached to the bottom thereof, wherein said cleaning sheet and comprises a nonwoven material.

15. A kit according to claim 14 further comprising instruction to discard said dirt bin after a single use.

16. A kit according to claim 14 wherein said dirt bin is made of material selected from the group consisting of cellulose, thermoformed plastic, foam and combinations thereof.

17. A kit according to claim 14 wherein said dirt bin further comprises an air filter juxtaposed with the top thereof.

* * * * *

UNITED STATES PATENT AND TRADEMARK OFFICE

CERTIFICATE OF CORRECTION

PATENT NO. : 7,934,287 B2
APPLICATION NO. : 12/221115
DATED : May 3, 2011
INVENTOR(S) : Widalys Luz De Soto-Burt et al.

It is certified that error appears in the above-identified patent and that said Letters Patent is hereby corrected as shown below:

Title Page,

Item [75] Inventors:

Line 7, delete "Brett Delainey" and insert --Brett Delainey Christie--.

Signed and Sealed this
Tenth Day of April, 2012

David J. Kappos

David J. Kappos
*Director of the United States Patent and Trademark Office*